US011049463B2

(12) United States Patent
Lin et al.

(10) Patent No.: US 11,049,463 B2
(45) Date of Patent: Jun. 29, 2021

(54) DRIVING METHODS WITH VARIABLE FRAME TIME

(75) Inventors: Craig Lin, San Jose, CA (US); Bryan Chan, San Francisco, CA (US)

(73) Assignee: E INK CALIFORNIA, LLC, Fremont, CA (US)

( * ) Notice: Subject to any disclaimer, the term of this patent is extended or adjusted under 35 U.S.C. 154(b) by 0 days.

(21) Appl. No.: 13/004,763

(22) Filed: Jan. 11, 2011

(65) Prior Publication Data

US 2011/0175875 A1 Jul. 21, 2011

Related U.S. Application Data

(60) Provisional application No. 61/295,628, filed on Jan. 15, 2010.

(51) Int. Cl.
*G09G 3/34* (2006.01)

(52) U.S. Cl.
CPC ..... *G09G 3/344* (2013.01); *G09G 2300/08* (2013.01); *G09G 2310/06* (2013.01)

(58) Field of Classification Search
CPC ..... G09G 2310/06; G09G 3/344; G09G 2300/08; G09G 3/34
USPC ..... 345/107, 209; 359/296
See application file for complete search history.

(56) References Cited

U.S. PATENT DOCUMENTS 4,143,947 A 3/1979 Aftergut et al.
4,259,694 A 3/1981 Liao
4,443,108 A 4/1984 Webster
4,568,975 A 2/1986 Harshbarger et al.
4,575,124 A 3/1986 Morrison et al.
5,266,937 A 11/1993 DiSanto et al.
5,298,993 A 3/1994 Edgar et al.
5,754,584 A 5/1998 Durrant et al.
5,831,697 A 11/1998 Evanicky et al.
5,923,315 A 7/1999 Ueda et al.
5,926,617 A 7/1999 Ohara et al.
6,005,890 A 12/1999 Clow et al.
6,045,756 A 4/2000 Carr et al.
6,069,971 A 5/2000 Kanno et al.
6,075,506 A 6/2000 Bonnett et al.
(Continued)

FOREIGN PATENT DOCUMENTS

CN 1813279 A 8/2006
CN 1849639 A 10/2006
(Continued)

OTHER PUBLICATIONS

U.S. Appl. No. 12/046,197, filed Mar. 11, 2008, Wang et al.
(Continued)

*Primary Examiner* — Jeff Piziali
(74) *Attorney, Agent, or Firm* — Zhen Bao

(57) ABSTRACT

The present invention is directed to driving waveforms and a driving method for an electrophoretic display. The method and waveforms have the advantage that the changes in the driving voltages due to the shift are minimized. In addition, the overall driving time for the waveforms is also shortened due to the shortened driving frames. There are no additional data points required as the number of the driving frames remains the same. Therefore, the power consumption is nearly identical with the waveform having driving frames of a fixed frame time.

7 Claims, 12 Drawing Sheets

(56) References Cited

U.S. PATENT DOCUMENTS

| | | | | |
|---|---|---|---|---|
| 6,111,248 | A | 8/2000 | Melendez et al. | |
| 6,154,309 | A | 11/2000 | Otani et al. | |
| 6,473,072 | B1 | 10/2002 | Comiskey et al. | |
| 6,504,524 | B1 | 1/2003 | Gates et al. | |
| 6,531,997 | B1 | 3/2003 | Gates et al. | |
| 6,532,008 | B1 | 3/2003 | Guranlnick | |
| 6,639,580 | B1 | 10/2003 | Kishi et al. | |
| 6,657,612 | B2 | 12/2003 | Machida et al. | |
| 6,671,081 | B2 | 12/2003 | Kawai | |
| 6,674,561 | B2 | 1/2004 | Ohnishi et al. | |
| 6,686,953 | B1 | 2/2004 | Holmes | |
| 6,796,698 | B2 | 9/2004 | Sommers et al. | |
| 6,903,716 | B2 | 6/2005 | Kawabe et al. | |
| 6,914,713 | B2 | 7/2005 | Chung et al. | |
| 6,927,755 | B2 | 8/2005 | Chang | |
| 6,970,155 | B2 | 11/2005 | Cabrera | |
| 6,982,178 | B2 | 1/2006 | LeCain et al. | |
| 6,995,550 | B2 | 2/2006 | Jacobson et al. | |
| 7,177,066 | B2 | 2/2007 | Chung et al. | |
| 7,184,196 | B2 | 2/2007 | Ukigaya | |
| 7,202,847 | B2 | 4/2007 | Gates | |
| 7,242,514 | B2 | 7/2007 | Chung et al. | |
| 7,277,074 | B2 | 10/2007 | Shih | |
| 7,283,119 | B2 | 10/2007 | Kishi | |
| 7,307,779 | B1 | 12/2007 | Cernasov et al. | |
| 7,349,146 | B1 | 3/2008 | Douglass et al. | |
| 7,504,050 | B2 | 3/2009 | Weng et al. | |
| 7,528,822 | B2 | 5/2009 | Amundson et al. | |
| 7,705,823 | B2 | 4/2010 | Nihei et al. | |
| 7,710,376 | B2 | 5/2010 | Edo et al. | |
| 7,733,311 | B2 | 6/2010 | Amundson et al. | |
| 7,773,069 | B2 | 8/2010 | Miyasaka et al. | |
| 7,800,580 | B2 | 9/2010 | Johnson et al. | |
| 7,804,483 | B2 | 9/2010 | Zhou et al. | |
| 7,816,440 | B2 | 10/2010 | Matsui | |
| 7,839,381 | B2 | 11/2010 | Zhou et al. | |
| 7,952,558 | B2 | 5/2011 | Yang et al. | |
| 7,999,787 | B2 | 8/2011 | Amundson et al. | |
| 8,009,348 | B2 | 8/2011 | Zehner et al. | |
| 8,035,611 | B2 | 10/2011 | Sakamoto | |
| 8,054,253 | B2 | 11/2011 | Yoo | |
| 8,102,363 | B2 | 1/2012 | Hirayama | |
| 8,125,501 | B2 | 2/2012 | Amundson et al. | |
| 8,179,387 | B2 | 5/2012 | Shin et al. | |
| 8,243,013 | B1 * | 8/2012 | Sprague et al. | 345/107 |
| 8,334,836 | B2 | 12/2012 | Kanamori et al. | |
| 8,405,600 | B2 | 3/2013 | Reis et al. | |
| 2002/0021483 | A1 | 2/2002 | Katase | |
| 2002/0033792 | A1 | 3/2002 | Inoue | |
| 2003/0095090 | A1 | 5/2003 | Ham | |
| 2003/0137521 | A1 | 7/2003 | Zehner et al. | |
| 2003/0193565 | A1 | 10/2003 | Wen et al. | |
| 2004/0246562 | A1 | 12/2004 | Chung et al. | |
| 2004/0263450 | A1 | 12/2004 | Lee et al. | |
| 2005/0001812 | A1 | 1/2005 | Amundson et al. | |
| 2005/0162377 | A1 | 7/2005 | Zhou et al. | |
| 2005/0179642 | A1 | 8/2005 | Wilcox et al. | |
| 2005/0185003 | A1 | 8/2005 | Dedene et al. | |
| 2005/0210405 | A1 | 9/2005 | Ernst et al. | |
| 2005/0219184 | A1 | 10/2005 | Zehner et al. | |
| 2006/0023126 | A1 | 2/2006 | Johnson et al. | |
| 2006/0050361 | A1 | 3/2006 | Johnson | |
| 2006/0119567 | A1 | 6/2006 | Zhou et al. | |
| 2006/0132426 | A1 | 6/2006 | Johnson | |
| 2006/0139305 | A1 | 6/2006 | Zhou et al. | |
| 2006/0139309 | A1 | 6/2006 | Miyasaka | |
| 2006/0164405 | A1 | 7/2006 | Zhou | |
| 2006/0187186 | A1 | 8/2006 | Zhou et al. | |
| 2006/0232547 | A1 | 10/2006 | Johnson et al. | |
| 2006/0262147 | A1 | 11/2006 | Kimpe et al. | |
| 2007/0035510 | A1 | 2/2007 | Zhou et al. | |
| 2007/0046621 | A1 | 3/2007 | Suwabe et al. | |
| 2007/0046625 | A1 | 3/2007 | Yee | |
| 2007/0052668 | A1 | 3/2007 | Zhou et al. | |
| 2007/0070032 | A1 | 3/2007 | Chung et al. | |
| 2007/0080926 | A1 | 4/2007 | Zhou et al. | |
| 2007/0080928 | A1 | 4/2007 | Ishii et al. | |
| 2007/0091117 | A1 | 4/2007 | Zhou et al. | |
| 2007/0103427 | A1 | 5/2007 | Zhou et al. | |
| 2007/0109274 | A1 | 5/2007 | Reynolds | |
| 2007/0132687 | A1 | 6/2007 | Johnson | |
| 2007/0146306 | A1 | 6/2007 | Johnson et al. | |
| 2007/0159682 | A1 | 7/2007 | Takanak et al. | |
| 2007/0176889 | A1 | 8/2007 | Zhou et al. | |
| 2007/0182402 | A1 | 8/2007 | Kojima | |
| 2007/0188439 | A1 | 8/2007 | Kimura et al. | |
| 2007/0247417 | A1 * | 10/2007 | Miyazaki et al. | 345/107 |
| 2007/0262949 | A1 | 11/2007 | Zhou et al. | |
| 2007/0276615 | A1 | 11/2007 | Cao et al. | |
| 2007/0296690 | A1 | 12/2007 | Nagasaki | |
| 2008/0150886 | A1 | 6/2008 | Johnson et al. | |
| 2008/0158142 | A1 | 7/2008 | Zhou et al. | |
| 2008/0211833 | A1 | 9/2008 | Inoue | |
| 2008/0266243 | A1 | 10/2008 | Johnson et al. | |
| 2008/0273022 | A1 | 11/2008 | Komatsu | |
| 2008/0303780 | A1 | 12/2008 | Sprague et al. | |
| 2009/0096745 | A1 | 4/2009 | Sprague et al. | |
| 2009/0267970 | A1 | 10/2009 | Wong et al. | |
| 2010/0134538 | A1 | 6/2010 | Sprague et al. | |
| 2010/0149169 | A1 | 6/2010 | Miyasaka | |
| 2010/0194733 | A1 | 8/2010 | Lin et al. | |
| 2010/0194789 | A1 | 8/2010 | Lin et al. | |
| 2010/0238203 | A1 | 9/2010 | Stroemer et al. | |
| 2010/0283804 | A1 | 11/2010 | Sprague et al. | |
| 2010/0295880 | A1 | 11/2010 | Sprague et al. | |
| 2011/0096104 | A1 * | 4/2011 | Sprague et al. | 345/690 |
| 2011/0175945 | A1 * | 7/2011 | Lin | 345/690 |
| 2011/0216104 | A1 * | 9/2011 | Chan et al. | 345/690 |
| 2011/0298776 | A1 * | 12/2011 | Lin | 345/211 |
| 2012/0120122 | A1 * | 5/2012 | Lin et al. | 345/690 |

FOREIGN PATENT DOCUMENTS

| | | | |
|---|---|---|---|
| CN | 101009083 | A | 8/2007 |
| CN | 101236727 | | 8/2008 |
| JP | 200214654 | A | 1/2002 |
| JP | 2009-1927896 | | 8/2009 |
| KR | 10-2008-0055331 | | 6/2008 |
| TW | 200506783 | | 2/2005 |
| TW | 200625223 | | 7/2006 |
| WO | WO 2005/004099 | | 1/2005 |
| WO | WO 2005/031688 | | 4/2005 |
| WO | WO 2005/034076 | | 4/2005 |
| WO | WO 2009/049204 | | 4/2009 |
| WO | WO 2010/132272 | | 11/2010 |

OTHER PUBLICATIONS

U.S. Appl. No. 12/115,513, filed May 5, 2008, Sprague et al.

U.S. Appl. No. 12/909,752, filed Oct. 21, 2010, Sprague et al.

U.S. Appl. No. 13/009,711, filed Jan. 19, 2011, Lin et al.

U.S. Appl. No. 61/311,693, filed Mar. 8, 2010, Chan et al.

U.S. Appl. No. 61/351,764, filed Jun. 4, 2010, Lin.

U.S. Appl. No. 61/412,746, filed Nov. 11, 2010, Lin, et al.

Kao, WC., Ye, JA., Chu, MI., and Su, CY. (Feb. 2009) Image Quality Improvement for Electrophoretic Displays by Combining Contrast Enhancement and Halftoning Techniques. *IEEE Transactions on Consumer Electronics*, 2009, vol. 55, Issue 1, pp. 15-19.

Kao, WC., (Feb. 2009) Configurable Timing Controller Design for Active Matrix Electrophoretic Dispaly. *IEEE Transactions on Consumer Electronics*, 2009, vol. 55, Issue 1, pp. 1-5.

Kao, WC., Ye, JA., and Lin, C. (Jan. 2009) Image Quality Improvement for Electrophoretic Displays by Combining Contrast Enhancement and Halftoning Techniques. *ICCE 2009 Digest of Technical Papers*, 11.2-2.

Kao, WC., Ye, JA., Lin, FS., Lin, C., and Sprague, R. (Jan. 2009) Configurable Timing Controller Design for Active Matrix Electrophoretic Display with 16 Gray Levels. *ICCE 2009 Digest of Technical Papers*, 10.2-2.

Kao, WC., Fang, CY., Chen, YY., Shen, MH., and Wong, J. (Jan. 2008) Integrating Flexible Electrophoretic Display and One-Time

(56) References Cited

OTHER PUBLICATIONS

Password Generator in Smart Cards. *ICCE 2008 Digest of Technical Papers*, p. 4-3. (Int'l Conference on Consumer Electronics, Jan. 9-13, 2008).
U.S. Appl. No. 13/004,763, filed Jan. 11, 2011, Lin et al.
U.S. Appl. No. 13/471,004, filed May 14, 2012, Sprague et al.
U.S. Appl. No. 13/597,089, filed Aug. 28, 2012, Sprague et al.

* cited by examiner

| Line No. | Within a Frame Time (20 ms) Updating Begins at |
|---|---|
| 1 | 0 µs |
| 2 | ~33.33 µs |
| 3 | ~66.67 µs |
| ..... | |
| 300 | ~9.966 ms |
| ..... | |
| 599 | ~19.931 ms |
| 600 (Last) | ~19.965 ms |

Figure 6

| Line No. | Within a Frame Time (10 ms) Updating Begins at |
|---|---|
| 1 | 0 μs |
| 2 | ~16.67 μs |
| 3 | ~33.34 μs |
| ..... | |
| 300 | ~4.984 ms |
| ..... | |
| 599 | ~9.969 ms |
| 600 (Last) | ~9.985 ms |

Figure 9

DRIVING METHODS WITH VARIABLE FRAME TIME

This application claims priority to U.S. Provisional Application No. 61/295,628, filed Jan. 15, 2010; the content of which is incorporated herein by reference in its entirety.

TECHNICAL FIELD

The present invention relates to driving waveforms and a driving method for an electrophoretic display.

BACKGROUND OF THE INVENTION

An electrophoretic display (EPD) is a non-emissive device based on the electrophoresis phenomenon of charged pigment particles suspended in a solvent. The display usually comprises two plates with electrodes placed opposing each other and one of the electrodes is transparent. A suspension composed of a colored solvent and charged pigment particles dispersed therein is enclosed between the two plates. When a voltage difference is imposed between the two electrodes, the pigment particles migrate to one side or the other, causing either the color of the pigment particles or the color of the solvent to be seen, depending on the polarity of the voltage difference.

The modern electrophoretic display application often utilizes the active matrix backplane to drive the images. The active matrix driving, however, may result in updating images from the top of the display panel to the bottom of the display panel in a non-synchronized manner. The present invention addresses such a deficiency.

SUMMARY OF THE INVENTION

The present invention is directed to a waveform for driving an electrophoretic display. The waveform comprises a plurality of driving frames and the driving frames have varying frame times.

In one embodiment, the driving frames at the transition time points of the waveform have a first frame time and the remaining driving frames have a second frame time.

In one embodiment, the first frame time is a fraction of the second frame time.

In one embodiment, the first frame time is about 5% to about 80% of the second frame time.

In one embodiment, the first frame time is about 5% to about 60%, of the second frame time.

In one embodiment, the waveform is a mono-polar waveform.

In one embodiment, the waveform is a bi-polar waveform.

The present invention is directed to a driving method for an electrophoretic display. The method comprises applying the waveform of this invention to pixels.

BRIEF DESCRIPTION OF THE DRAWINGS

FIGS. 5*a*, 5*b*, 6, 7*a*, 7*b* illustrate problems associated with active matrix driving of an electrophoretic display.

FIGS. 8 and 9 illustrate a mono-polar driving method of the present invention.

DETAILED DESCRIPTION OF THE INVENTION

Figure 1:
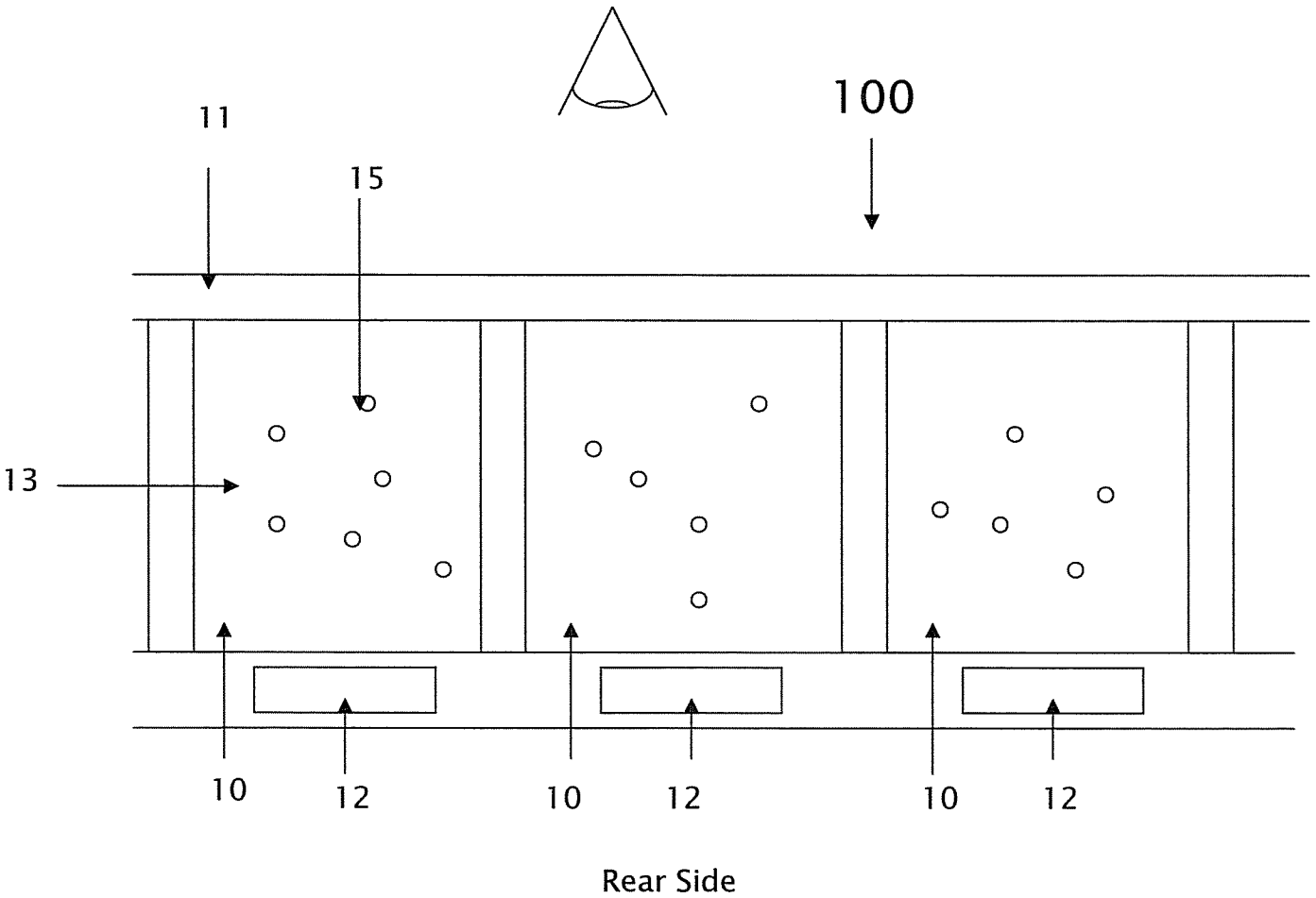
FIG. 1 is a cross-section view of a typical electrophoretic display device.

FIG. 1 illustrates a typical electrophoretic display 100 comprising a plurality of electrophoretic display cells 10. In FIG. 1, the electrophoretic display cells 10, on the front viewing side indicated with the graphic eye, are provided with a common electrode 11 (which is usually transparent and therefore on the viewing side). On the opposing side (i.e., the rear side) of the electrophoretic display cells 10, a substrate includes discrete pixel electrodes 12. Each of the pixel electrodes defines an individual pixel of the electrophoretic display. In practice, a single display cell may be associated with one discrete pixel electrode or a plurality of display cells may be associated with one discrete pixel electrode.

An electrophoretic fluid 13 comprising charged pigment particles 15 dispersed in a solvent is filled in each of the display cells. The movement of the charged particles in a display cell is determined by the driving voltage associated with the display cell in which the charged particles are filled.

If there is only one type of pigment particles in the electrophoretic fluid, the pigment particles may be positively charged or negatively charged. In another embodiment, the electrophoretic display fluid may have a transparent or lightly colored solvent or solvent mixture and charged particles of two different colors carrying opposite charges, and/or having differing electro-kinetic properties.

The display cells may be of a conventional walled or partition type, a microencapsulated type or a microcup type. In the microcup type, the electrophoretic display cells may be sealed with a top sealing layer. There may also be an adhesive layer between the electrophoretic display cells and the common electrode. The term "display cell" therefore is intended to refer to a micro-container which is individually filled with a display fluid. Examples of "display cell" include, but are not limited to, microcups, microcapsules, micro-channels, other partition-typed display cells and equivalents thereof.

The term "driving voltage" is used to refer to the voltage potential difference experienced by the charged particles in the area of a pixel. The driving voltage is the potential difference between the voltage applied to the common electrode and the voltage applied to the pixel electrode. As an example, in a binary system, positively charged white particles are dispersed in a black solvent. When zero voltage is applied to a common electrode and a voltage of +15V is applied to a pixel electrode, the "driving voltage" for the charged pigment particles in the area of the pixel would be +15V. In this case, the driving voltage would move the positively charged white particles to be near or at the common electrode and as a result, the white color is seen through the common electrode (i.e., the viewing side). Alternatively, when zero voltage is applied to a common electrode and a voltage of −15V is applied to a pixel electrode, the driving voltage, in this case, would be −15V and under such −15V driving voltage, the positively charged white particles would move to be at or near the pixel electrode, causing the color of the solvent (black) to be seen at the viewing side.

Figure 2:
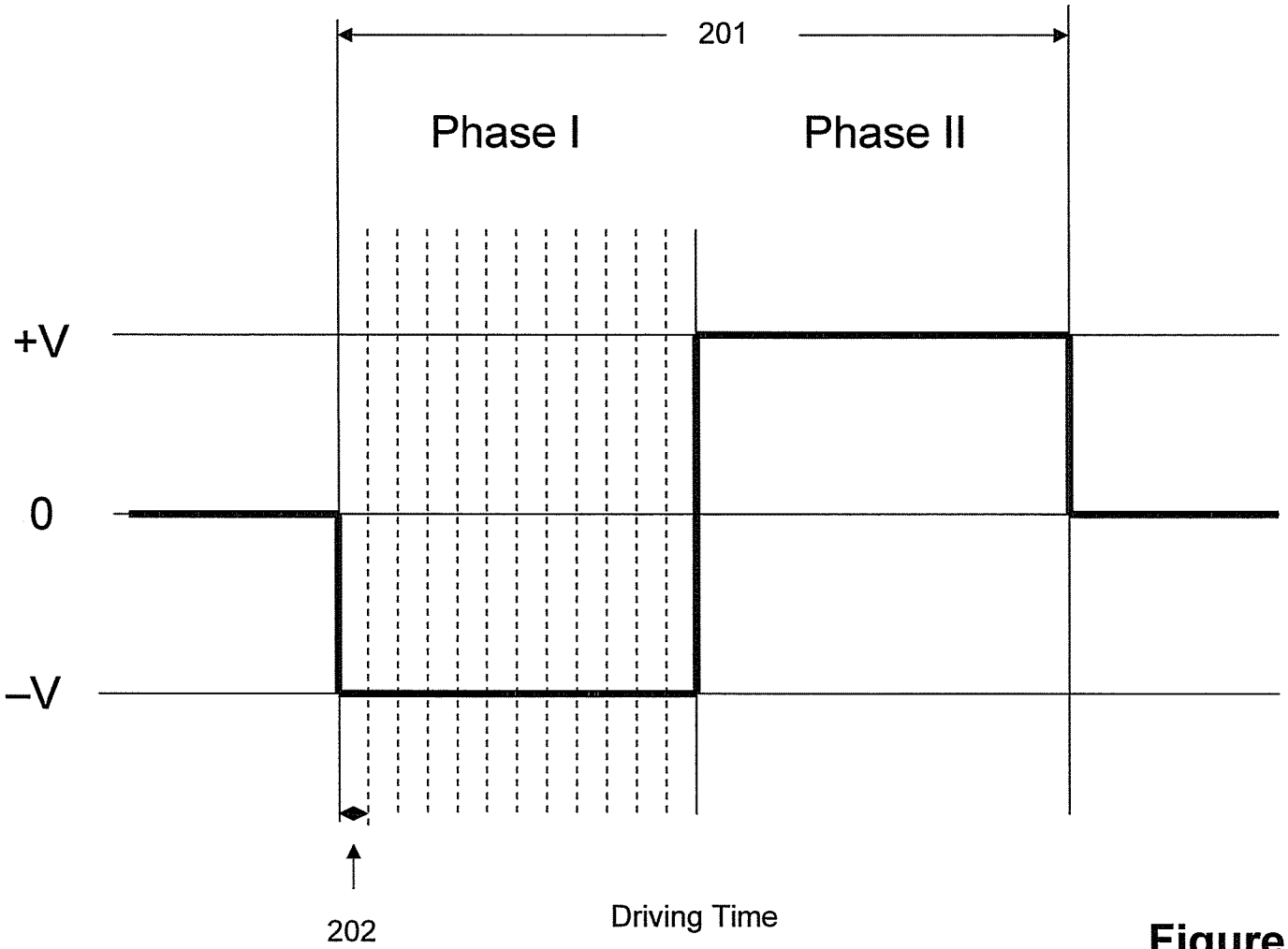
FIG. 2 illustrates an example driving waveform.

FIG. 2 shows an example of a driving waveform for a single pixel. For a driving waveform, the vertical axis denotes the intensity of the applied voltages whereas the horizontal axis denotes the driving time. The length of 201 is the driving waveform period. There are two driving phases, I and II, in this example driving waveform.

There are driving frames 202 (or referred to as simply "frame" in this application) within the driving waveform as shown. When driving an EPD on an active matrix backplane, it usually takes many frames for the image to be displayed. During each frame, a voltage is applied to a pixel. For example, during frame period 202, a voltage of −V is applied to the pixel.

The length of a frame (i.e., frame time) is an inherent feature of an active matrix TFT driving system and it is usually set at 20 milli-second (msec). But typically, the length of a frame may range from 2 msec to 100 msec.

There may be as many as 1000 frames in a waveform period, but usually there are 20-40 frames in a waveform period.

Figure 3:
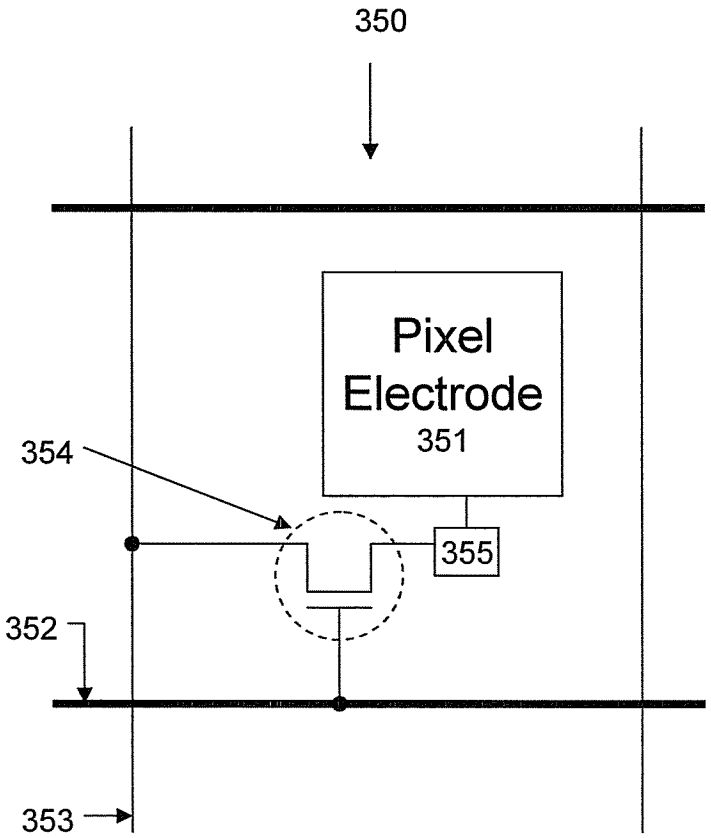
FIG. 3 illustrates the structure of a pixel.

An active matrix driving mechanism is often used to drive an electrophoretic display. In general, an active matrix display device includes a display unit on which the pixels are arranged in a matrix form. A diagram of the structure of a pixel is illustrated in FIG. 3. Each individual pixel such as element 350 on the display unit is disposed in each of intersection regions defined by two adjacent scanning signal lines (i.e., gate signal lines) 352 and two adjacent image signal lines (i.e., source signal lines) 353. The plurality of scanning signal lines 352 extending in the column-direction are arranged in the row-direction, while the plurality of image signal lines 353 extending in the row-direction intersecting the scanning signal lines 352 are arranged in the column-direction. Gate signal lines 352 couple to gate driver ICs and source signal lines 353 couple to source driver ICs.

More specifically, a thin film transistor (TFT) array is composed of a matrix of pixels and pixel electrode region 351 (a transparent electric conducting layer) each with a TFT device 354 and is called an array. A significant number of these pixels together create an image on the display. For example, an EPD may have an array of 600 lines by 800 pixels/line, thus 480,000 pixels or TFT units.

A TFT device 354 is a switching device, which functions to turn each individual pixel on or off, thus controlling the number of electrons flow into the pixel electrode zone 351 through a capacitor 355. As the number of electrons reaches the expected value, TFT turns off and these electrons can be maintained.

Figure 4:
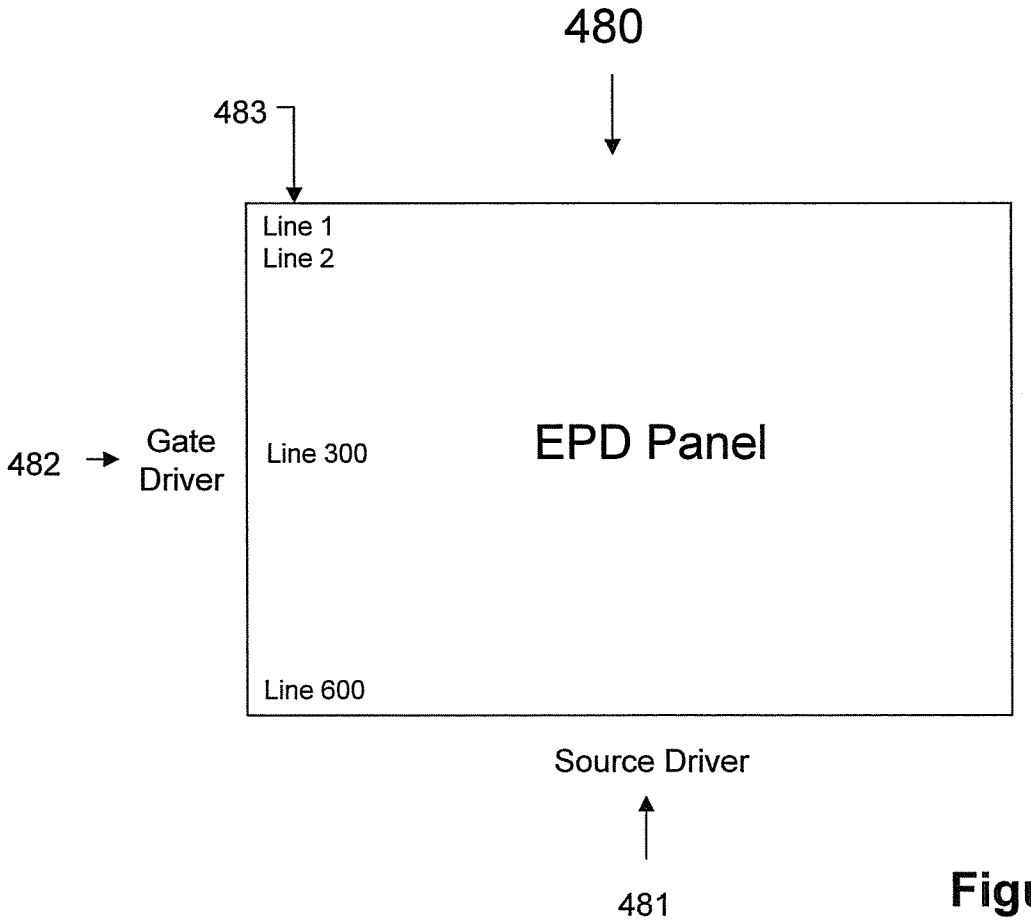
FIG. 4 illustrates an active matrix backplane.

FIG. 4 illustrates an active matrix backplane 480 for an EPD. In an active matrix backplane, the source driver 481 is used to apply proper voltages to the line of the pixels. And the gate driver 482 is used to trigger the update of the pixel data for each line 483.

The charged particles in a display cell corresponding to a pixel are driven to a desired location by a series of driving voltages (i.e., driving waveform) as shown in FIG. 2 as an example.

In practice, the common electrode and the pixel electrodes are separately connected to two individual circuits and the two circuits in turn are connected to a display controller. The display controller sends waveforms, frame to frame, to the circuits to apply appropriate voltages to the common and pixel electrodes respectively. The term "frame" represents timing resolution of a waveform, as illustrated above.

FIGS. 5-7 illustrate problems associated with active matrix driving of an electrophoretic display.

For illustration purpose, FIGS. 5-10 represent a case in which the electrophoretic display comprises display cells which are filled with a display fluid having positively charged white particles dispersed in a black colored solvent.

In FIGS. 5-7, each of the waveforms in these examples has 8 frames in each phase and each frame has a fixed frame time of 20 msec. The display image (800×600) has 800 pixels per line and 600 lines.

For a frame time of 20 msec and a display image of 800 pixels/line and 600 lines, the updating time for each line of pixels is about 33.33 micro-second (μsec). As shown in FIG. 6, the updating of line 1 of the image begins at time 0, updating of line 2 begins at 33.33 μsec, updating of line 3 begins at 66.67 μsec and the so on. The updating of the last line (line 600) therefore would begin at 19.965 msec.

The updating of the common electrode begins at time 0. Therefore, updating of the lines, except line 1, always lags behind updating of the common electrode. In this example, the updating of the last line lags behind the updating of the common electrode for almost one frame time of 20 msec.

Figure 5A:
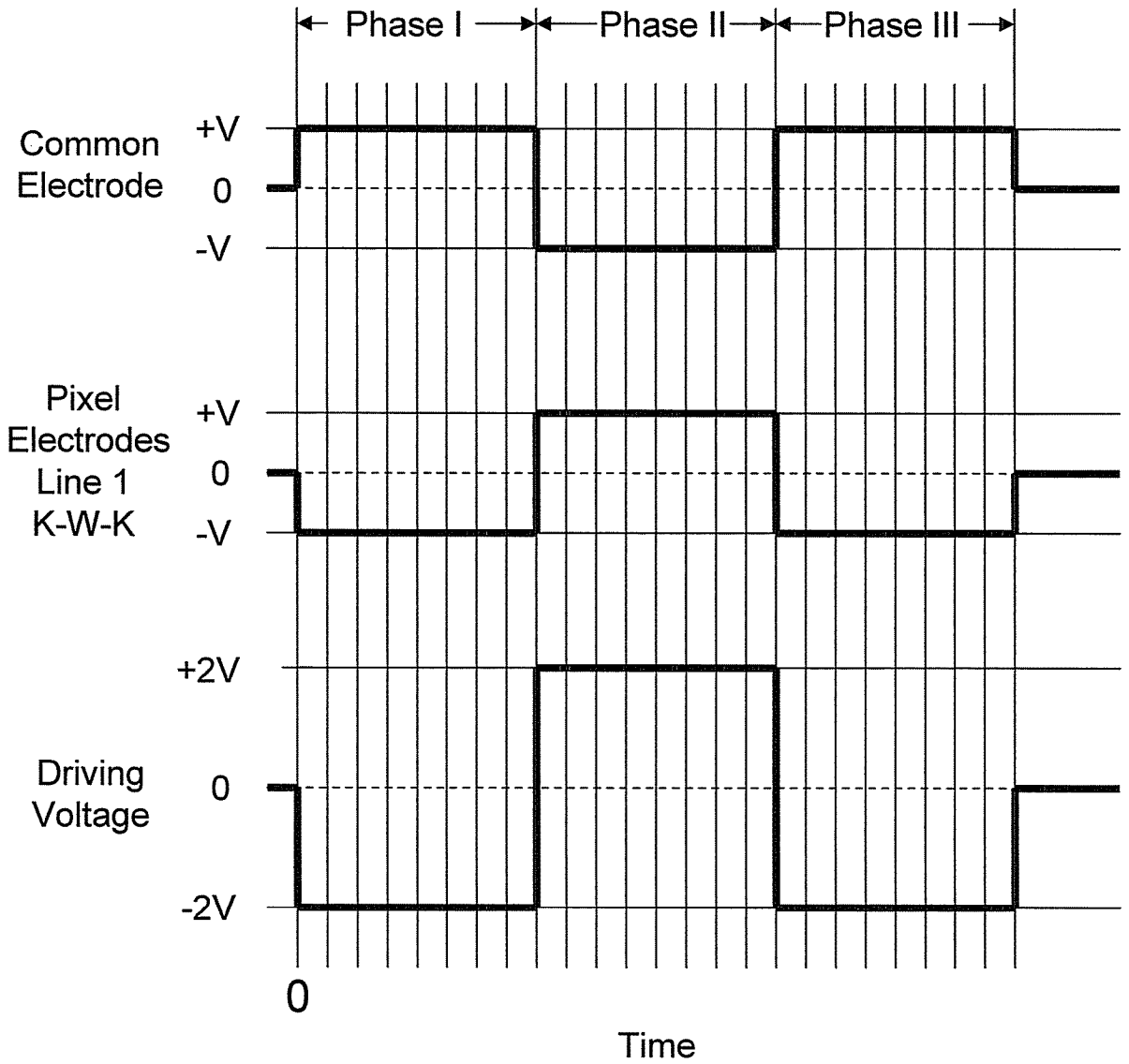
Figure 5B:
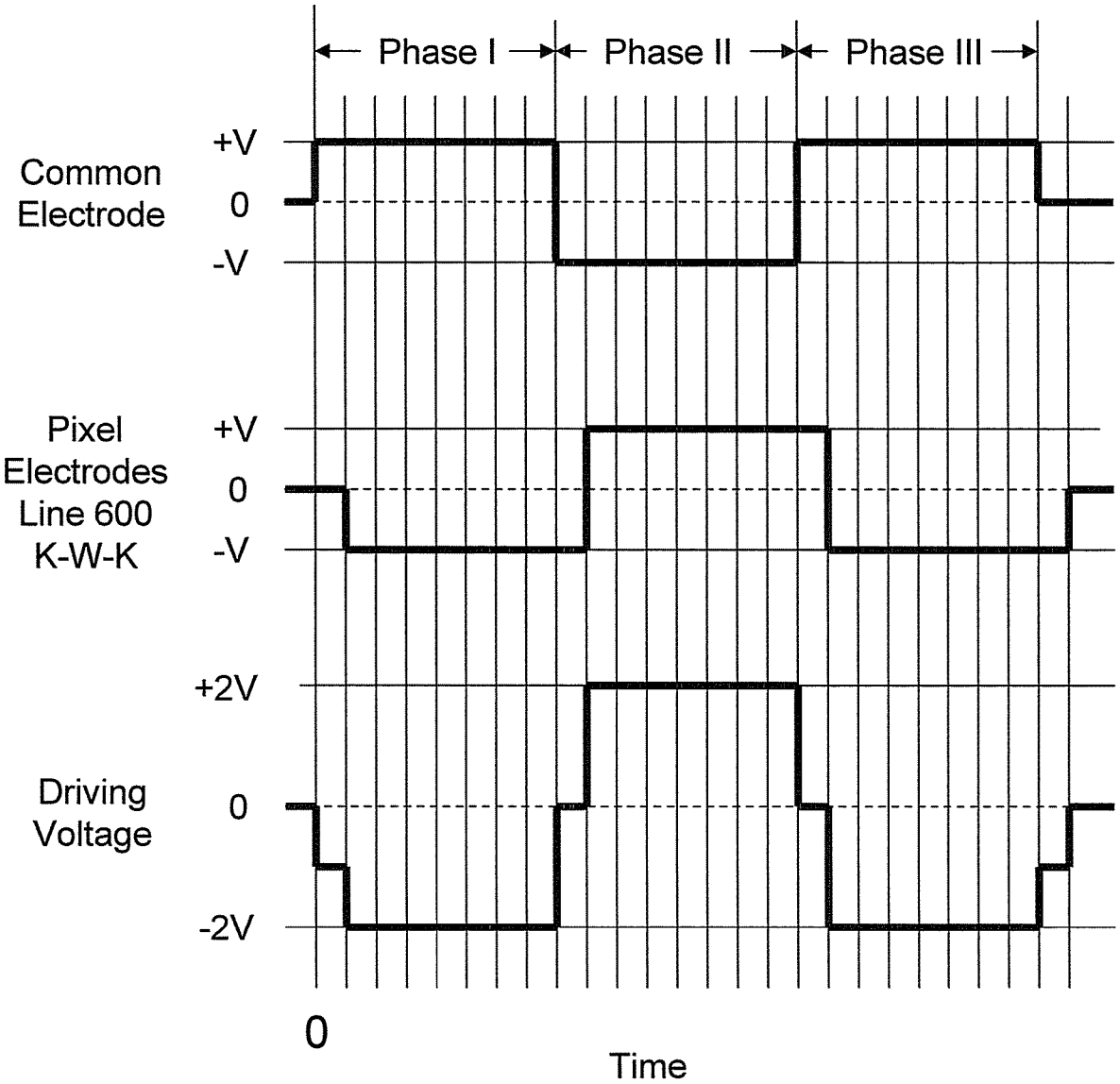

FIGS. 5*a* and 5*b* show how a waveform drives a pixel to black state, then to white state and finally to black state again.

As shown in the two figures, the mono-polar driving approach requires modulation of the common electrode. In both figures, the common electrode is applied a voltage of +V in phase I, a voltage of −V in phase II and a voltage of +V in phase III.

FIG. 5*a* represents the driving of the first line where there is no lag time for updating of the pixel electrode. As shown, a voltage of −V is applied in phase I, a voltage of +V is applied in phase II and a voltage of −V is applied in phase III, to the pixel electrode. As a result, the pixels experience driving voltages of −2V, +2V and −2V in phase I, II and III, respectively and updating of the common electrode and updating of the pixel electrode (for a pixel driven to black, to white and then to black) are synchronized as both start at time 0. In other words, voltages applied to the common electrode are synchronized with voltages applied to the first line of the pixel electrodes.

However, the pixel updating does not occur simultaneously across the entire display panel as shown in FIG. 6. The first line of the pixels and the last line of the pixels have an update time difference of about one frame time. But the voltages applied to the common electrode are updated without a lag in time.

FIG. 5*b* represents the driving of the last line where updating of the pixel electrode lags behind updating of the common electrode by almost a frame time (i.e., 20 msec). Because of this lag/shift, updating of the common electrode and the updating of the pixel electrodes are not synchronized. In other words, the lag in updating the pixel electrode results in a non-synchronized updating of the waveform from the top of the panel to the bottom of the panel.

FIG. 5*b* also shows that the shift/lag is most pronounced at every transition time point, as a result of which, the shift/lag causes the last line to behave differently from the first line. This results in non-uniformity of the images displayed.

It is noted that while the shift is most pronounced for the last line, it also occurs with other lines, except line 1, as shown in FIG. 6.

Figure 7A:
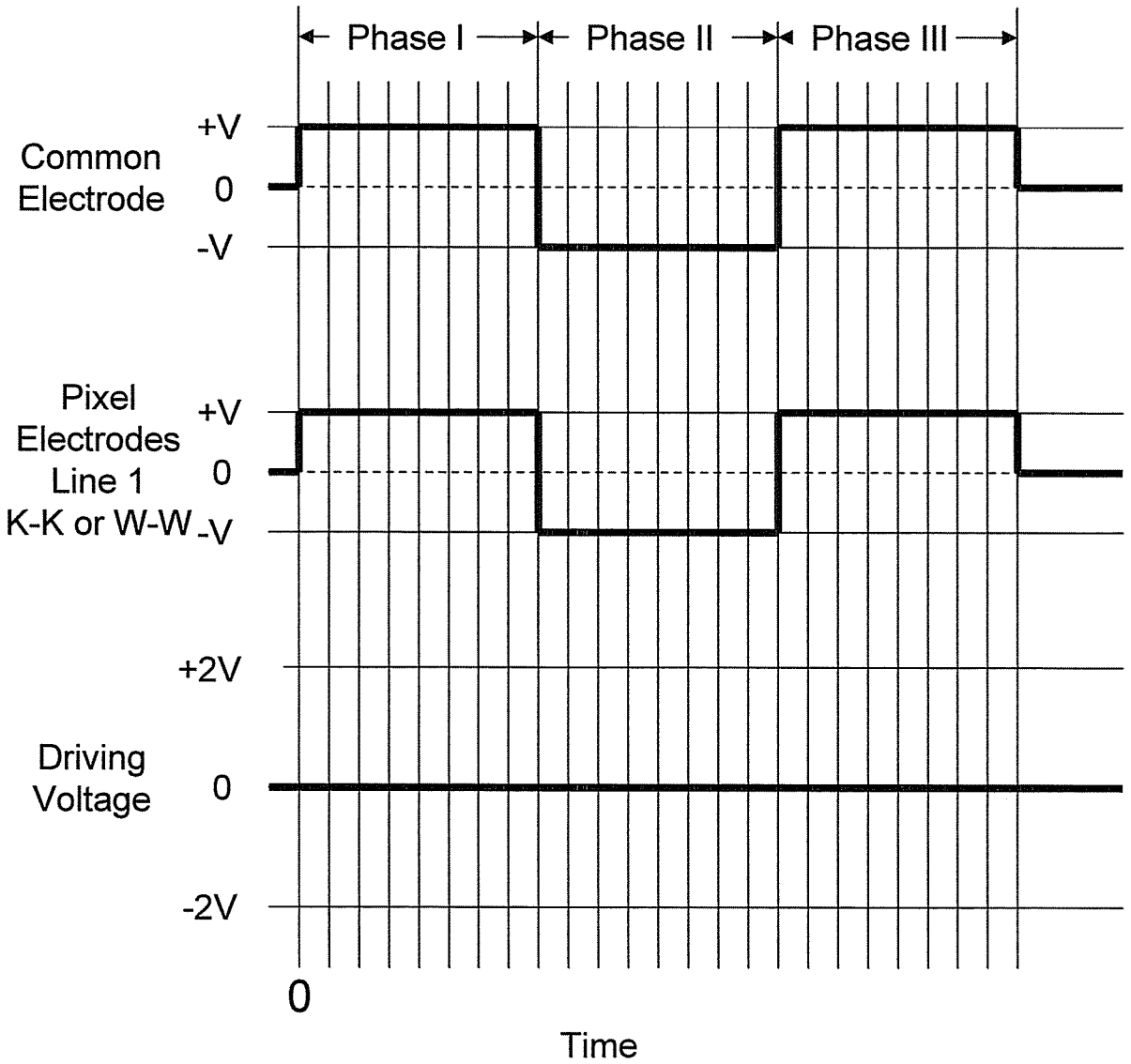
Figure 7B:
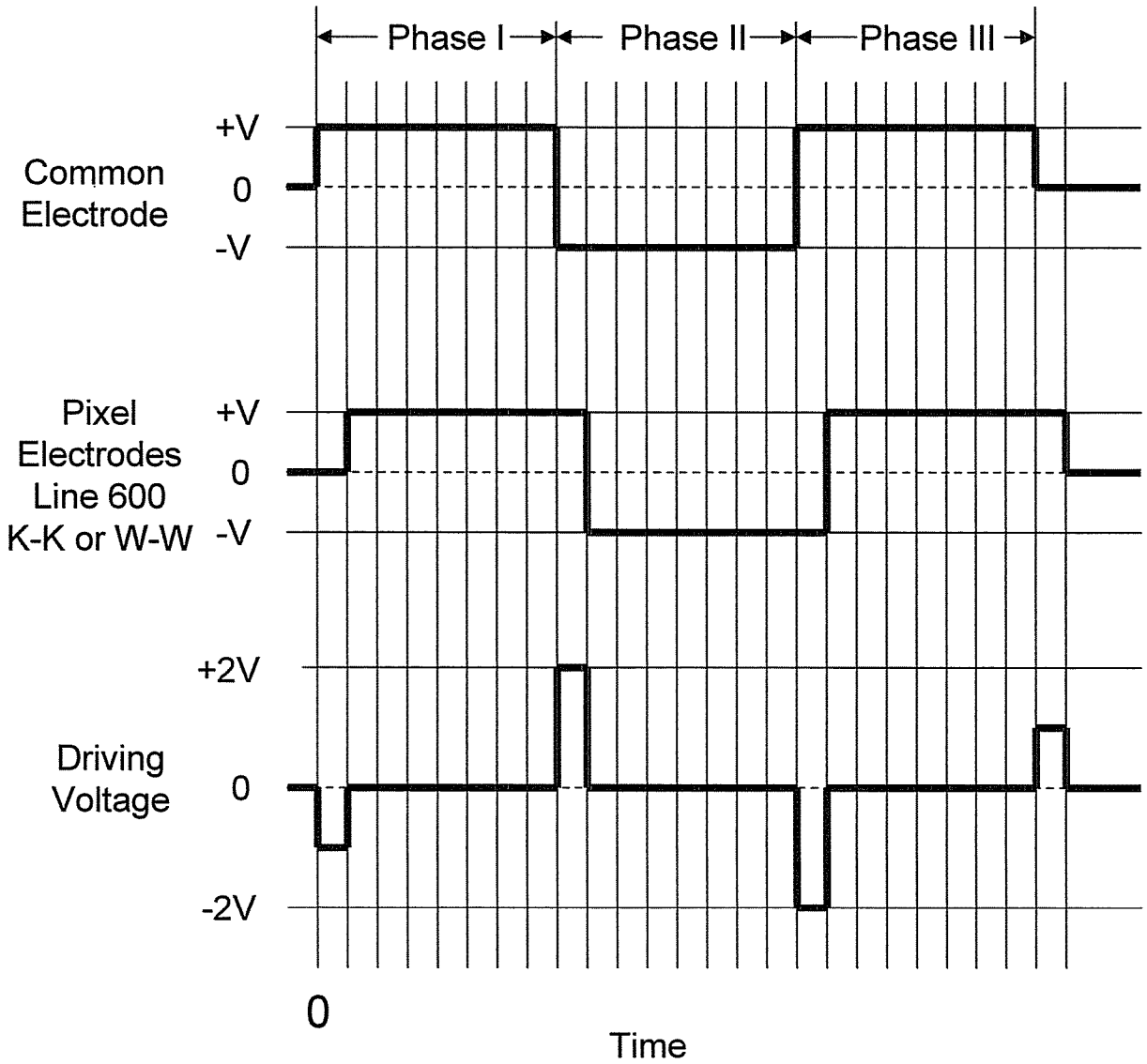

In FIGS. 7*a* and 7*b*, the pixels are intended to remain their original color state, i.e., white pixels remain in white or black pixels remain in black. For these pixels, the driving voltages should remain 0V. However, this is only possible for the pixels in the first line of the image to have driving voltages being 0V, as shown in FIG. 7*a*. The pixels in the last line have driving voltages at each transition point due to the lag/shift as discussed above, as shown in FIG. 7*b*. This will cause the pixels to change their color states at those transition time points, which is not desired.

The first aspect of the present invention is directed to a driving method which comprises applying waveform to pixels wherein said waveform comprises a plurality of driving frames and the driving frames have varying frame times.

In one embodiment, the driving frames at the transition time points of the waveform have a first frame time and the remaining driving frames have a second frame time. The term "transition time point" is intended to refer to the time point at which a different voltage is applied. For example, at a transition time point, the voltage applied may raise from 0V to +V or from −V to +V or may decrease from +V to 0V or from +V to −V, etc.

In one embodiment, the first frame time is a fraction of the second frame time. For example, the first frame time may be from about 5% to about 80% of the second frame time, preferably from about 5% to about 60%, of the second frame time.

Figure 8:
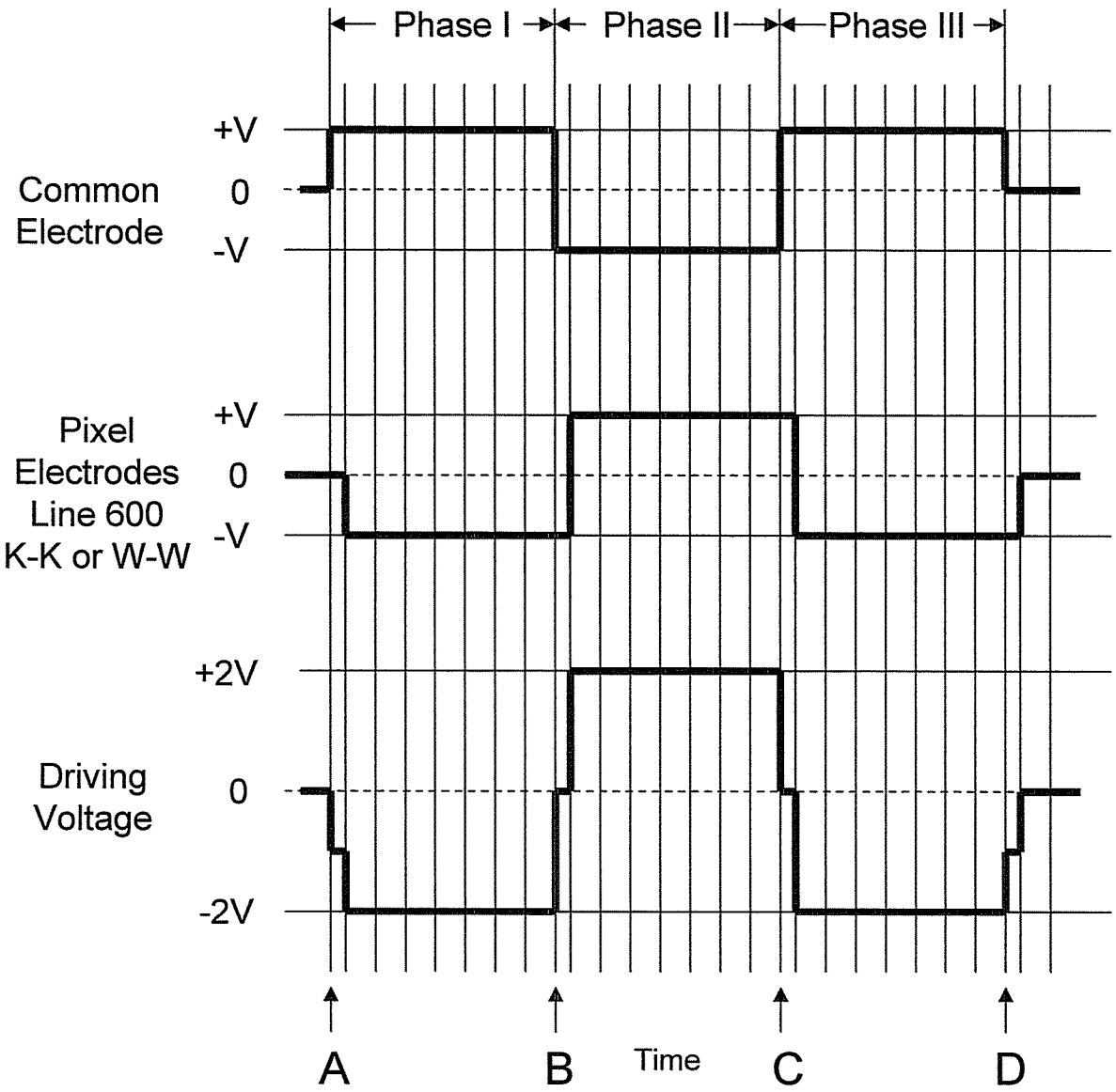

FIGS. 8 and 9 illustrate the present invention. As shown in FIG. 8, at the transition time points A, B, C and D, the frame time is 10 msec while the rest of the driving frames have a frame time of 20 msec. There are still 8 frames in each phase and the frame times are in the order of 10 msec, 20 msec, 20 msec, 20 msec, 20 msec, 20 msec, 20 msec and 20 msec, from frame 1 to frame 8.

In the frames with the shortened frame time, each line driving time is also shortened to 16.67 μsec. As the result, the lag time for each line (other than line 1) is also shortened. The updating of the last line in the driving frames of the shortened frame time lags behind the updating of the common electrode is only about 10 msec, as shown in FIG. 9.

By comparing FIGS. 5*b* and 8, the advantages of the present driving method are clear. First of all, the changes in the driving voltages due to the shift are minimized. Secondly the overall driving time for the waveform is also shortened due to the shortened driving frames.

In addition, there are no additional data points required as the number of the driving frames remains the same, which leads to the same number of charging of the TFT capacitor. Therefore the power consumption is nearly identical with the waveform having driving frames of a fixed frame time.

This driving method can be designed and incorporated into a timing controller (i.e., a display controller) which generates and provides driving frames of varying frame times to the source and gate driver IC in an active matrix driving scheme.

The second aspect of the invention is directed to driving waveform comprising a plurality of driving frames wherein said driving frames have varying frame times.

In one embodiment, the driving frames at the transition time points of the waveform have a first frame time and the remaining driving frames have a second frame time.

In a further embodiment, the first frame time is a fraction of the second from time. For example, the first frame time may be from about 5% to about 80% of the second frame time, preferably from about 5% to about 60%, of the second frame time.

FIG. 8 relates to a mono-polar driving waveform as modulation of the voltages applied to the common electrode with the voltages applied to the pixel electrodes is needed.

Figure 10:
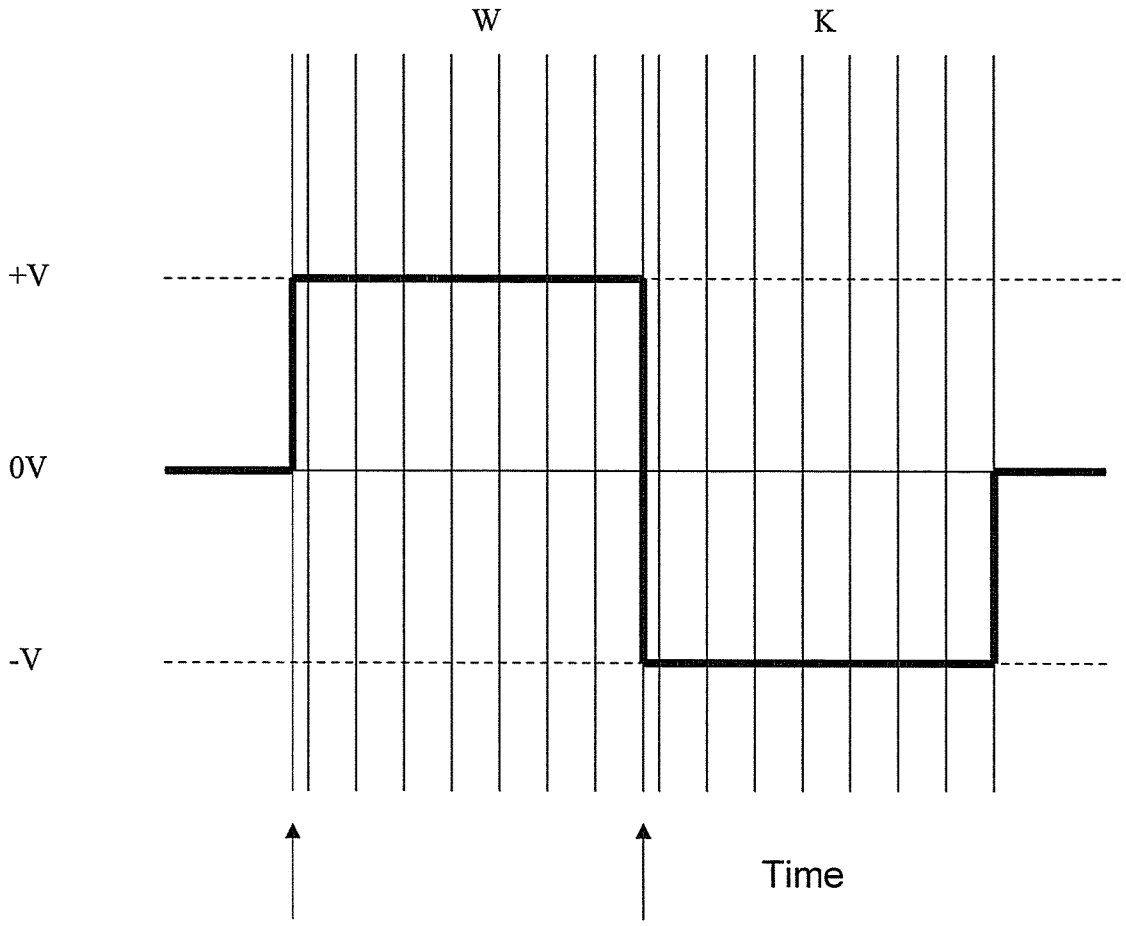
FIG. 10 illustrates a bi-polar driving method of the present invention.

Although the driving method and waveform of the present invention are especially beneficial to the mono-polar driving approach, the bi-polar driving approach can also take advantage of the method to shorten the overall driving time, as shown in FIG. 10. For the bi-polar driving without modulation of the common electrode, the shortened driving frames are preferably at the transition time points as shown. It is also possible to have the shortened driving frames at other time points in a waveform, especially for grayscale driving as the shortened driving frames would increase the resolution of the grayscale images.

Although the foregoing disclosure has been described in some detail for purposes of clarity of understanding, it will be apparent to a person having ordinary skill in that art that certain changes and modifications may be practiced within the scope of the appended claims. It should be noted that there are many alternative ways of implementing both the method and system of the present invention. Accordingly, the present embodiments are to be considered as exemplary and not restrictive, and the inventive features are not to be limited to the details given herein, but may be modified within the scope and equivalents of the appended claims.

What is claimed is:

1. A method for driving an electrophoretic display including a plurality of pixels, the method comprising:

applying a common voltage to a common electrode associated with the plurality of pixels, the common voltage being configured to alternate between a positive bias voltage, a negative bias voltage, or a zero-volt bias voltage;

applying a first driving phase to at least one individual pixel of said plurality of pixels, the first driving phase comprising a first instance of a shortened driving frame having a first frame time, and a first plurality of regular driving frames each of which has a second frame time; and applying a second driving phase to said at least one individual pixel of said plurality of pixels, the second driving phase comprising a second instance of the shortened driving frame having the first frame time, and a second plurality of regular driving frames each of which has the second frame time;

wherein the first frame time of the first instance and the second instance of the shortened driving frame is about 5% to about 80% in duration of the second frame time of the first plurality of regular driving frames and the second plurality of regular driving frames;

wherein each of the first instance and the second instance of the shortened driving frame occurs at a transition time point, at which a driving waveform for the electrophoretic display transitions from one driving phase among multiple driving phases including the first driving phase and the second driving phase to another driving phase among the multiple driving phases including the first driving phase and the second driving phase, wherein the transition time point is a time point at which the common voltage alternates between the positive bias voltage, the negative bias voltage, or the zero-volt bias voltage;

wherein the electrophoretic display comprising a plurality of pixel electrodes, each of said plurality of pixels is sandwiched between the common electrode and a pixel electrode of said plurality of pixel electrodes;

wherein the electrophoretic display further includes an active matrix driving system that applies a driving voltage to said at least one individual pixel of said plurality of pixels during each driving frame being one of the first instance or the second instance of the shortened driving frame or the first plurality of regular driving frames or the second plurality of regular driving frames.

2. The method of claim 1, wherein the first frame time is about 5% to about 60% of the second frame time.

3. The method of claim 1, wherein a voltage is applied to the common electrode in each of the first driving phase and the second driving phase and the voltages applied to the common electrode in the first driving phase and the second driving phase are not identical.

4. The method of claim 1, wherein the first instance and the second instance of the shortened driving frames have the first frame time that is identical in the first driving phrase and the second driving phase.

5. The method of claim 4, wherein the first plurality of regular driving frames and the second plurality of regular driving frames have the second frame time that is identical in the first driving phase and the second driving phase.

6. The method of claim 1, wherein the active matrix driving system applies a first constant voltage to said at least one individual pixel during all driving frames including the shortened driving frame and the regular driving frames of the first driving phase, and wherein the active matrix driving system applies a second constant voltage to said at least one individual pixel during all driving frames including the shortened driving frame and the second plurality of regular driving frames.

7. The method of claim 1, wherein the shortened driving frame of the first driving phase is equal to the shortened driving frame of the second driving phase.

* * * * *